US005152515A

United States Patent [19]

Acquaviva

[11] Patent Number: 5,152,515

[45] Date of Patent: Oct. 6, 1992

[54] VARIABLE TRAJECTORY DOCUMENT RESTACKING SYSTEM

[75] Inventor: Thomas Acquaviva, Penfield, N.Y.

[73] Assignee: Xerox Corporation, Stamford, Conn.

[21] Appl. No.: 846,095

[22] Filed: Mar. 5, 1992

[51] Int. Cl.[5] ..... B65H 5/22

[52] U.S. Cl. ..... 271/3.1; 414/794.6; 271/81; 271/207

[58] Field of Search ..... 271/3.1, 81, 184, 201, 271/207, 213; 414/794.5, 794.6

[56] References Cited

U.S. PATENT DOCUMENTS

| | | | |
|---|---|---|---|
| 3,772,972 | 11/1973 | Dutro et al. | 414/794.5 |
| 4,436,301 | 3/1984 | Doery et al. | 271/177 |
| 4,469,319 | 9/1984 | Robb et al. | 271/3.1 |
| 4,480,824 | 11/1984 | Acquaviva | 271/3.1 |
| 4,858,909 | 8/1989 | Stemmle | 271/184 |
| 4,958,827 | 9/1990 | Kaneko | 271/81 |
| 4,960,272 | 10/1990 | Wierszewski et al. | 271/3.1 |
| 5,033,731 | 7/1991 | Looney | 271/207 |
| 5,076,558 | 12/1991 | Bergeron et al. | 271/3.1 |
| 5,078,378 | 1/1992 | Kapadia et al. | 271/3.1 |

FOREIGN PATENT DOCUMENTS

| | | | |
|---|---|---|---|
| 48780 | 2/1989 | Japan | 271/207 |

*Primary Examiner*—H. Grant Skaggs

[57] ABSTRACT

In a stacking system for sequentially feeding flimsy sheets to be stacked in a generally horizontal stack thereof in a stacking tray by ejecting the sheets sequentially out over the stack with a preset sheet ejection trajectory angle to fall by gravity and settle onto the top of the stack, first estimating the height of the stack in the stacking tray to provide a stack height control signal proportional to the height of the stack, and then changing the sheet ejection trajectory angle at which the sheets are to be ejected in response to this stack height control signal before the sheets are ejected such that the sheet ejection trajectory angle, and the height of the release point of the sheet at ejection relative to the tray, is automatically lowered for smaller stack heights and automatically raised for an increased stack height, to thereby minimize the settling time of ejected sheets onto the stack for improved restacking for a wide range of stack heights. Where the sheets are ejected from adjacent one side of the tray towards an impact position with a restacking wall adjacent an opposite side of the tray, the change in trajectory angle desirably changes this impact position.

10 Claims, 2 Drawing Sheets

VARIABLE TRAJECTORY DOCUMENT RESTACKING SYSTEM

Figure 1:
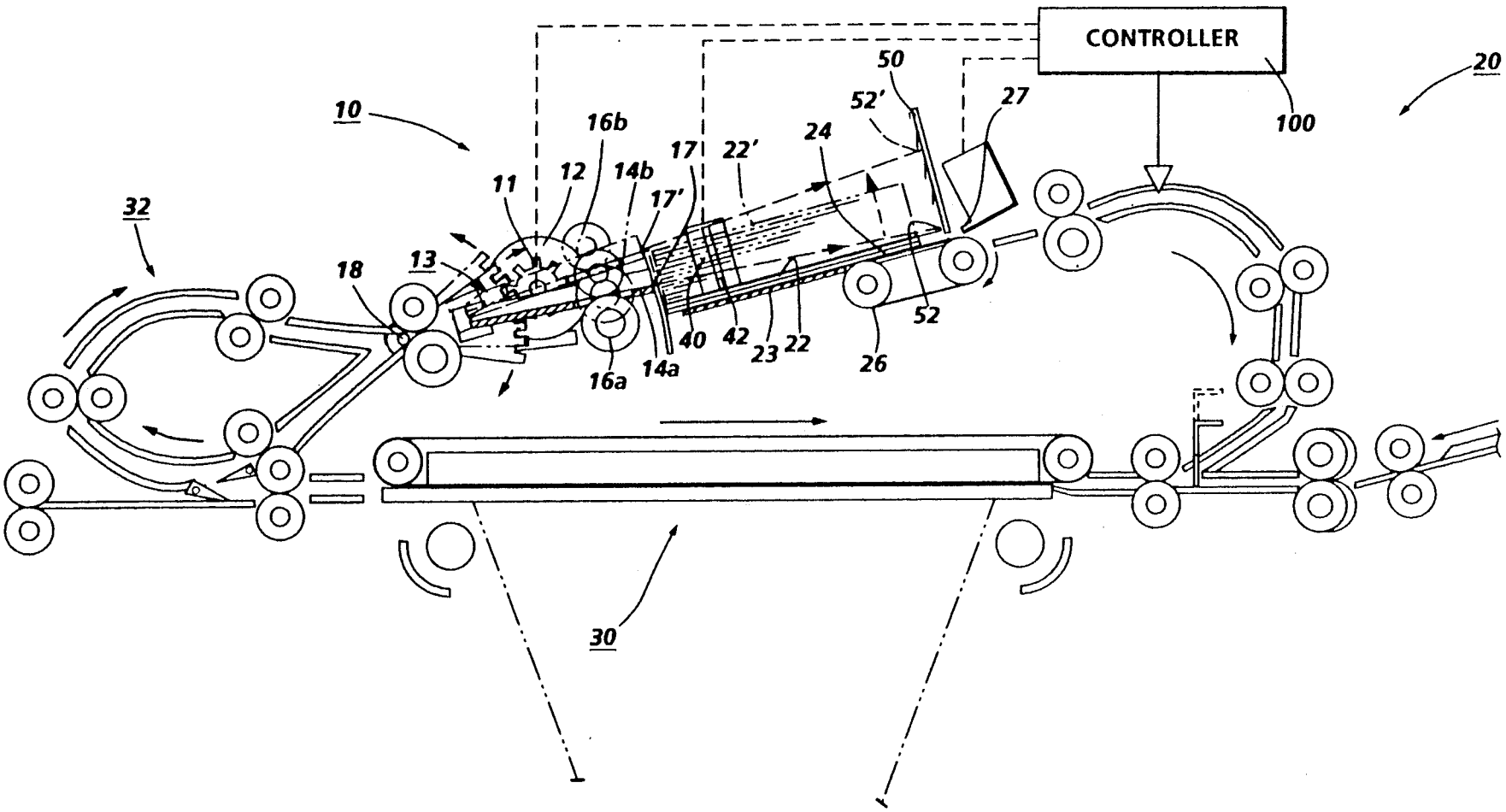

The present invention relates to an improved and relatively simple system for stacking flimsy sheets, such as paper documents, in which a variable sheet ejection trajectory is provided which is varied automatically with stack height for improved sheet stacking.

The present system has particular application in the more rapid and more reliable restacking of original document sheets in an open stacking document handler tray or bin for a copier, printer or scanner, especially where the sheets must be rapidly recirculated for inversion before copying, or for multiple collated copies by multiple recirculations. However, the disclosed system has other potential sheet stacking improvement applications, such as high speed finisher compilers and output stackers.

A significant disadvantage of ejecting sheets high above the top sheet of a stack of sheets onto which that ejected sheet must stack is that light-weight sheets of paper have a relatively long settling time. The dropping or settling of a generally horizontal sheet is resisted by its large air resistance as it is being urged down onto the top of the stack by its relatively very small gravitational force.

Various problems of sheet restacking, especially the settling of an ejected sheet onto the top of the stack, are well known in the art, including specific document handler applications. For example, the type of recirculating document handler (RDH) described in Xerox Corporation U.S. Pat. No. 5,078,378, issued Jan. 7, 1992, and others cited therein, is also disclosed herein merely by way of one example of one application of the present system. A specific example of one approach to improving control over such RDH tray document restacking is shown in Xerox Corporation U.S. Pat. No. 4,469,319, issued Sep. 4, 1984 to F. J. Robb, et al. It teaches variable corrugation of the sheets, which corrugation is increased as the sheet ejection rollers and associated baffles are moved back horizontally with the rear wall of the tray to accommodate larger dimension sheets in the tray. That patent also teaches flexible sheet deflecting or knock-down flaps 100, 101, 102 at the sheet ejection position. U.S. Pat. No. 5,076,558, issued Dec. 31, 1991 to M. J. Bergeron, et al., also utilizes such flexible deflecting flaps (142), plus air pressure somehow directed at the ejected sheets (141). Xerox Corporation U.S. Pat. No. 4,436,301 to M. S. Doery, et al, further discusses restacking difficulties and has an overstack vacuum transport and mechanical bail lead edge knock-down system. However, such sheet "knock down" systems tend to undesirably deflect down prematurely the lead edge of the ejected sheet. Also, such "knock down" systems can interfere with sheet stack removal or loading and can be damaged thereby.

In another context, it is known to rotate the relative nip position or angle between exit rollers of a copy sheet output stacker or duplexing tray to change the sheet feeding orientation during the feeding out of a copy sheet into a tray, for different reasons, as taught in Xerox Corporation U.S. Pat. No. 4,858,909, issued Aug. 22, 1989 to Denis J. Stemmle.

Further by way of background, the restacking of original document sheets is particularly difficult because of the wide variations in thickness, material, weight and condition (such as pre-existing curls, creases, dog-ears, etc.), of original document sheets. Different document sheets may even be intermixed in the same document sets to be copied sequentially together. Yet, as shown in the references, open operator access is desired for a document loading tray. Also, the same document loading tray must also provide for restacking of the documents after feeding and imaging in many cases. Thus, the document sheets are often effectively flown or thrown into the tray from the one end thereof providing the sheet restacking or return transport. That is, the document sheet is not typically effectively controlled or guided once it is released into the open restacking tray area, and must fall by gravity into the tray to settle onto the top of the stack, which is resisted by the high air resistance of the sheet in that direction. Yet, in a document handler for a high speed copier or other imager, restacking must be done at high speed. Sheet restacking time, especially the settling time, is a major limiting factor in the rate of document handling.

Typically, as shown in the example herein, each document sheet travels generally horizontally (at an upward trajectory) and planarly, primarily by inertia, until the lead edge of the document strikes a generally vertical restacking wall surface on the opposite side of the tray from the document ejection area. However, the trajectory must accommodate variations in the pre-existing height of the stack of sheets already in the tray (varying with the document set size and sheet thickness). The trajectory must also accommodate the varying aerodynamic characteristics of a rapidly moving sheet, which can act as an airfoil to affect the rise or fall of the lead edge of the sheet as it is ejected. Thus, typically, a relatively high restacking ejection upward trajectory angle and a relatively high impingement point on the restacking wall are provided. Otherwise, the lead edge of the entering document can catch or snub on the top of the sheet stack already in the restacking tray, and curl over, causing a serious jam condition. [Further discussion of such RDH restacking problems, and others, is provided, for example, in the same inventor's U.S. Pat. No. 4,480,824, issued Nov. 6, 1984, on a document tray jam detection system.] However, setting a sufficiently high document trajectory angle to accommodate all these restacking problems greatly increases the sheet settling time for all sheets.

In the system disclosed herein, the reentry trajectory path or aim of sheets being stacked is varied, and is normally set much lower, to reduce sheet settling time, by coordinating and setting the sheet entry trajectory automatically in response to variations in the stack heights of the stack over which the entering sheets are being fed and ejected.

One specific feature of the specific embodiment disclosed herein is to provide in a stacking system (method of apparatus) for sequentially feeding flimsy sheets to be stacked in a generally horizontal stack thereof in a stacking tray by ejecting the sheets sequentially out over the stack with a preset sheet ejection trajectory angle so that the sheets may fall by gravity and settle onto the top of the stack, the improvement comprising: estimating the height of the stack in said stacking tray to provide stack height control signals proportional to the height of the stack, and changing said sheet ejection trajectory angle at which the sheets are to be so ejected in proportional response to said stack height control signals, before the sheets are so ejected, so that said sheet ejection trajectory angle is automatically lowered for smaller stack heights and automatically raised for increased stack heights, to thereby minimize the settling time of ejected sheets onto the stack.

Further specific features provided by the system disclosed herein, individually or in combination, include those wherein said changing said sheet ejection trajectory angle comprises variably pivoting the sheet ejection path before the sheets are ejected into the tray; and/or also changing the height of the release point of the sheet at ejection relative to the tray; and/or wherein said sheets are ejected from adjacent one side of the tray towards an impact position on a restacking wall adjacent an opposite side of the tray, and wherein said change in sheet ejection trajectory angle correspondingly changes the ejected sheets said impact position on said restacking wall; and/or wherein the sheet ejection means includes sheet transport path baffles and ejection roller means, and/or means for variably pivoting said transport path baffles and ejection roller means as a pivotal unit in response to said stack height control signals; wherein said stacking tray is the document restacking tray of a recirculating document handler for feeding document sheets out from the bottom of said restacking tray to be imaged before entering the sheet ejection means.

As to specific hardware components which may be used with the subject apparatus, it will be appreciated that, as is normally the case, various such specific hardware components are known per se in other apparatus or applications, including the cited references and commercial applications thereof.

The disclosed apparatus may be readily operated and controlled in a conventional manner with conventional control systems. Some additional examples of various prior art copiers with document handlers and control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may, of course, vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. The controller signals may conventionally actuate various conventional electrical solenoid or cam-controlled sheet deflector fingers, motors or clutches in the selected steps or sequences as programmed. Conventional sheet path sensors, switches and bail bars, connected to the controller, may be utilized for sensing and timing the positions of documents, as is well known in the art, and taught in the above and other patents and products. Known copying systems utilize such conventional microprocessor control circuitry with such connecting switches and sensors for various functions, and need not be described herein.

All references cited in this specification, and their references, are incorporated by reference herein where appropriate for appropriate teachings of additional or alternative details, features, and/or technical background.

Figure 2:
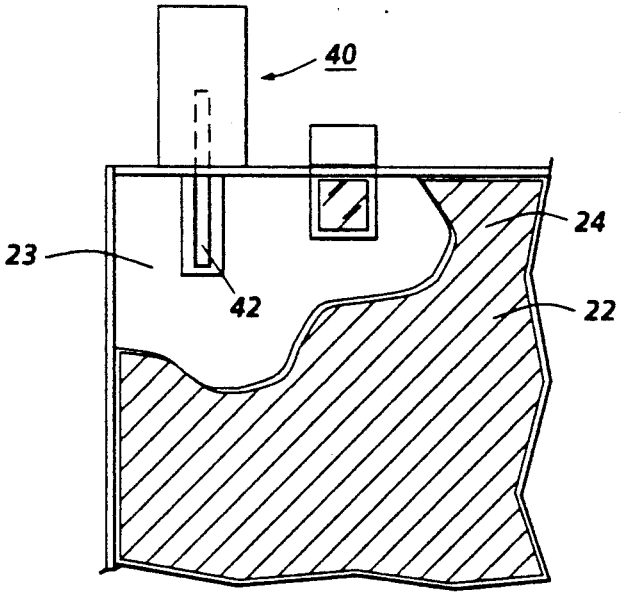
Figure 3:
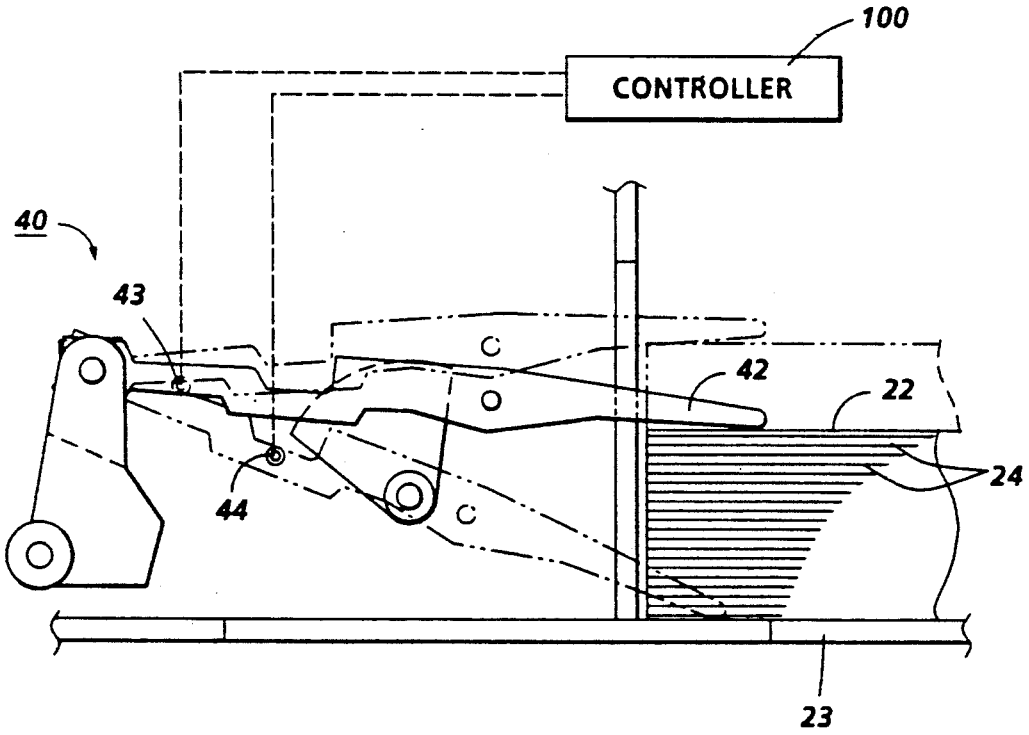
FIG. 3 PRIOR ART

Various of the above-mentioned and further features and advantages will be apparent from the specific apparatus and its operation described in the example below, as well as the claims. Thus the present invention will be better understood from this description of an embodiment thereof, including the drawing figures (approximately to scale) wherein:

FIG. 1 is a schematic front view of one (otherwise conventional) recirculating document handler incorporating the present variable trajectory sheet stacking system;

FIG. 2 is a partial top view and FIG. 3 is a partial enlarged side view illustrating a known combined separator and set height estimating or measuring system for the stacking system of FIG. 1. FIGS. 2 and 3 (labeled as prior art) are provided merely as one example of a suitable known means for measuring the set height of a stack of sheets in an RDH tray, as shown in the above cited U.S. Pat. No. 5,078,378 FIGS. 2 and 7.

The present invention is not limited to the specific apparatus examples illustrated herein. For example, U.S. Pat. No. 5,078,378 itself notes various other means for measuring the height of a stack of sheets in a tray, [for different purposes than the system herein].

Referring particularly to FIG. 1, there is shown one example of a variable trajectory sheet restacking system 10, incorporated into a recirculating document handler (RDH) 20 as shown in said U.S. Pat. No. 5,078,378 or the like. In the RDH 20, a set or stack 22 of individual document sheets 24 is fed out sequentially from a stacking tray 23 by a vacuum bottom sheet feeder 26 with an air knife 27 separator assist, as is well known in the art. [The air knife 27 can be turned off for very small sets, such as where only one or two sheets are in the tray 23 at the feedout time.] After the document sheets 24 are conventionally fed on by feed rollers as shown to an imaging station or platen 30, they may optionally be fed through and inverted by a duplex document inverting section or station 32. Here, the documents 24 being returned from the imaging station 30 are fed into the variable trajectory sheet restacking system 10 prior to their ejection at 17 for restacking into the area of the tray 23 over the set or stack 22. However, the present system can also be used with document handlers in which the documents are returned to the tray from the same side from which they are being fed out.

In this example, the restacking system 10 includes a stepper motor drive 11 driven by a motor control 12 to automatically reset both the sheet ejecting or trajectory angle and the position or height of sheet ejection. In this example, this is accomplished by pivotally mounting, as a pivotal output unit 13, the otherwise conventional copy sheet output baffles or guides 14*a*, 14*b* and ejecting roller pairs 16*a*, 16*b*. This entire exit path and exit drive unit 13 for the stacking sheets 24 may be pivoted about an upstream pivot axis 18. In this particular example (of which it will be obvious that there are many possible mechanical alternatives) the stepper motor drive 11 has a geared output which is driving a gear segment connected to the pivotal output path unit 13, so as to pivot said unit 13 about said pivot axis 18, thereby pivoting the output baffles 14 and eject rollers 16, as shown by the difference between the solid line and dashed line positions thereof in FIG. 1, and the corresponding different sheet ejection positions 17 and 17'. This movement to a selected portion between these two exemplary positions is varied in accordance with the different maximum to minimum exemplary stack heights set for that particular tray 23. These are correspondingly illustrated in FIG. 1 by solid and dashed lines for stacks 22 and 22'.

The sheet restacking system 10 stepper motor drive control 12 may be actuated and controlled by the conventional RDH or copier controller 100. The controller 100 is conventionally connected to a document stack set height measuring system 40. Here, this document stack height measuring system 40 comprises a conventional resettable set separator arm 42 resting on top of the stack 22 of sheets 24 in the RDH 20 tray 23. As shown in said U.S. Pat. No. 5,078,378, the resting position of the arm 42 of the set separator on top of the stack 22 can be used to approximately determine or estimate the set height of the stack 22 by the various different occlusion or nonocclusion combinations of optical sensors or switches 43 and 44 in different positions of the arm 42, or an extension thereof. That combination of height switch signals, as connected to the controller 100, provides sufficient information to the controller 100 to estimate the stack height, as further described in said patent. [As noted in this and other cited prior art patents, it is known to provide such signals for control of the air knife level of the air knife 27 or the like, so that the details of this control need not be described herein.] [As also described in said patent, further accuracy can be provided by counting the sheets as they are fed out, if desired.]

Thus, the conventional RDH 20 control logic in the controller 100 can be used to provide an approximate determination of the stack 22 to 22' height and provide corresponding control signals in response thereto. These are fed here to the control 12 for the stepper motor drive 11 to effect a corresponding pivoting of unit 13, so as to maintain the trajectory angle as low as practicable.

It is important to note that it is the height of the stack which is being measured for control of the restacking system 10 here, not the number of sheets in the stack, which varies with sheet thickness. However, in some other applications, such as an output tray, the accumulated output sheet tray entry count (since the tray was last emptied) could be used to provide a rough stack height estimate.

It will be appreciated that corrugation, even variable corrugation, may also be provided for the ejected sheets, as described in the cited patents, for the sheet restacking system 10, with the baffles 14 or the eject rollers 16 or otherwise. This, of course, helps to keep the sheet on a more linear ejection course as it is being ejected, resisting the tendency of the sheet to droop or curl by increasing the sheet's beam strength with the sheet corrugations, as is well known in the art.

In the restacking system 10 herein, a restacking alignment impingement wall 50 is provided, which may be conventional. That is, a front stop wall 50 at the opposite end of the restacking tray 23 extending well above the maximum height level of the top sheet of the thickest allowable stack 22. As shown in FIG. 1, in the system 10, there is a variable range of impingement positions or points from 52 to 52' on said impingement wall 50. The impingement wall 50 may be provided as is known, with a known downwardly fiber-oriented, "one-way fiber" material surface to partially absorb the restacking sheet lead edge impacts, and also to prevent the lead edge of the sheet from climbing upwardly on the wall 50 after its impact, even if curled upwardly.

In a typical prior art system, even when restacking into an empty tray, or a tray containing only a few documents, sheets impinge high up on the restack wall 50 and thus, take a long time to settle down to the feed mechanism 26 at the bottom of the tray 23. Also, the set separator finger 42 is actuated in response to the last sheet in the set entering the tray. If the set separator finger 42 is actuated then and attempts to rest on top of an unsettled sheet, the finger 42 can fall against or under the unsettled sheet. When that happens, a multifeed or fault condition will be generated and the machine shuts down. Therefore, it would be advantageous to aim sheets as low as possible on the restack wall 50 in order to minimize settling time. But, a document handler tray can contain anywhere from, say, 0 to 250 sheets, so the distance to the top of the stack is variable depending on the set size being used.

The present system automatically correspondingly adjusts the restacking impingement areas from 52 to 52' on the restack wall 50 as a function of the stack 22 height in the tray 23. This is done by said same operating of the stepper motor drive 11 to pivot the output path unit 13 and thus, raise or lower eject point 17 and the eject trajectory angles in response to the signals indicating the current actual stack heights. Yet, the desired corrugation shape and amplitude of the sheets can remain the same, because that aspect of the restacking system 10 need not be varied in this particular exemplary system. Another advantage besides faster settling and feeder acquistions is that the restacking wall 50 surface material can last longer, because the impingement point is being varied, so that the sheets do not wear the wall 50 surface in the same spot by impacting approximately the same spot all of the time.

This adjustment or resetting of the ejection trajectory and position for the restacking sheets in accordance with stack height is preferably completed prior to the first sheet reaching the feedout nip of the restacking eject rollers 16*a*, 16*b*, so that all of the restacking sheets are properly initially aimed for improved restacking. The adjustment of the output sheet trajectory angle and stopping height in this manner may desirably be done continuously or semicontinuously (periodically) using the height information provided. That is, while the changing of the sheet ejection trajectory angle at which the sheets are to be so ejected (in proportional response to said stack height control signal) is preferably done here before the sheets are so ejected, it may also be done during or afterwards. [Also note that it is the position of the output rollers 16 and ramps or baffles 14 which are adjusted here and not the nip geometry, i.e., the relative nip of the output rollers 16*a*, 16*b* need not be rotated. That would need a more complex mechanism, especially since at least one set of these rollers 16*a* or 16*b* must be driven.]

The present system automatically enables a higher speed recirculating document handler or the like, because each stacking sheet can be aimed so as to require less time for settling into the tray onto the top of the stack. The sheets being restacked spend less time in midair. Thus, the sheets can be stacked and, if desired, reacquired by the bottom feeder, much faster. Also, there is a reduced possibility of the set separator finger 42 being reset under a restacking sheet, or otherwise becoming jammed therewith. The disclosed system is believed to have the potential to extend the potential operating latitude without skipped pitches or lost productivity from stack heights of only two or three sheets up to stack heights of greater than 250 sheets in a high speed recirculating document handler.

Note that this system does not need any expensive elevator mechanisms or moving floors for the stack of sheets. The stacking tray 23 or other stacking tray can be a simple fixed bin or tray. That is particularly advantageous in the case of a bottom sheet feeder system, as disclosed herein, so as not to change the feeding position of the sheets being fed out of the stack 22.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a stacking system for sequentially feeding flimsy sheets to be stacked in a generally horizontal stack thereof in a stacking tray by ejecting the sheets sequentially out over the stack with a preset sheet ejection trajectory angle so that the sheets may fall by gravity and settle onto the top of the stack, the improvement comprising the steps of:

estimating the height of the stack in said stacking tray to provide stack height control signals proportional to the height of the stack, and changing said sheet ejection trajectory angle at which the sheets are to be so ejected in proportional response to said stack height control signals, before the sheets are so ejected, so that said sheet ejection trajectory angle is automatically lowered for smaller stack heights and automatically raised for increased stack heights, to thereby minimize the settling time of ejected sheets onto the stack.

2. The improved stacking system of claim 1, wherein said step of changing said sheet ejection trajectory angle comprises variably pivoting the sheet ejection path before the sheets are ejected into the tray.

3. The improved stacking system of claim 1, wherein said step of changing said sheet ejection trajectory angle comprises variably pivoting the sheet ejection path before the sheets are ejected into the tray and also changing the height of the release point of the sheet at ejection relative to the tray.

4. The improved stacking system of claim 1, wherein said sheets are ejected from adjacent one side of the tray towards an impact position on a restacking wall adjacent an opposite side of the tray, and wherein said change in sheet ejection trajectory angle correspondingly changes the ejected sheets said impact position on said restacking wall.

5. An improvement in sheet stacking apparatus wherein sheet ejection means ejects sheets into a stacking tray to stack therein by ejecting the sheets sequentially out over the stack with a preset sheet ejection trajectory angle so that the sheets may fall by gravity and settle onto the top of the stack, the improvement comprising:

means for estimating the height of the stack in said stacking tray to provide stack height control signals proportional to the height of the stack, and means for changing said sheet ejection trajectory angle of said sheet ejection means at which the sheets are to be so ejected in proportional response to said stack height control signal so that said sheet ejection trajectory angle is automatically lowered for smaller stack heights and automatically raised for increased stack heights, to thereby minimize the settling time of ejected sheets onto the stack.

6. The sheet stacking apparatus of claim 5, wherein said sheet ejection means includes sheet transport path baffles and ejection roller means, and said means for changing said sheet ejection trajectory angle comprises means for variably pivoting said transport path baffles and ejection roller means as a pivotal unit in response to said stack height control signals.

7. The sheet stacking apparatus of claim 6, wherein said sheet ejection means ejects sheets from adjacent one side of said tray towards an impact position on a restacking wall adjacent an opposite side of said tray, and wherein said change in sheet ejection trajectory angle correspondingly changes said impact position on said restacking wall.

8. The sheet stacking apparatus of claim 6, wherein said means for changing said sheet ejection trajectory angle also changes the height of the release point of the sheet at ejection relative to said tray.

9. The sheet stacking apparatus of claim 6, wherein said stacking tray is the document restacking tray of a recirculating document handler for simultaneously sequentially feeding document sheets out from the bottom of said restacking tray to be imaged before entering said sheet ejection means.

10. The sheet stacking apparatus of claim 5, wherein said sheet ejection means ejects sheets from adjacent one side of said tray towards an impact position on a restacking wall adjacent an opposite side of said tray, and wherein said change in sheet ejection trajectory angle correspondingly changes said impact position on said restacking wall.

* * * * *